United States Patent [19]

Hunstad

[11] 4,376,532

[45] Mar. 15, 1983

[54] EXERCISER FOR MUSCLES USED IN SKIING

[76] Inventor: Vernon D. Hunstad, 327 Hampden Dr. NE., Cedar Rapids, Iowa 52402

[21] Appl. No.: 240,526

[22] Filed: Mar. 4, 1981

[51] Int. Cl.[3] ..... A63B 23/04

[52] U.S. Cl. ..... 272/97; 272/146

[58] Field of Search ..... 272/97, 146, 144, 142, 272/96, 127, 126, 138

[56] References Cited

U.S. PATENT DOCUMENTS

| | | | |
|---|---|---|---|
| 2,445,274 | 11/1948 | Scriver | 272/97 |
| 3,421,760 | 1/1969 | Freeman | 272/96 |
| 3,547,434 | 12/1970 | Ossenkop | 272/97 |
| 3,559,986 | 2/1971 | Ehrmantraut | 272/127 |
| 3,612,519 | 10/1971 | Larson | 272/146 |
| 3,834,693 | 9/1974 | Poppenberger | 272/97 |

OTHER PUBLICATIONS

Advertising Brochure—Ski the Machine of Ken MacLeay Ent. Inc. Panorama City, CA.

*Primary Examiner*—Richard J. Johnson
*Attorney, Agent, or Firm*—Allan L. Harms

[57] ABSTRACT

Apparatus for providing exercise to muscles used in skiing. A pair of foot platforms are provided which are affixed by rocker assemblies above a pair of first platform members. The first platform members are each rotatively mounted to a base. Biasing springs interconnect the first platform members. Anchor means are provided for securing the tips of ski poles held by the user.

8 Claims, 7 Drawing Figures

EXERCISER FOR MUSCLES USED IN SKIING

BACKGROUND OF THE INVENTION

The actions of skiing utilize many muscles which are not flexed or extended in ordinary day-to-day activities. Various devices have been developed to provide apparatus, which when used, attempt to cause the user to experience flexion or extension of muscles necessary for proper skiing motions. Many of these devices seek to simulate the movement of the skier actually wearing the skis. These devices suffer the disadvantages of bulkiness, complexity and lack of portability. Other devices, though not placing skis on the feet of the user, attempt to accomplish these purposes but again suffer the shortcomings of complexity and bulkiness.

The instant invention provides apparatus to strengthen the foot, ankle, knee and leg muscles that are involved in the twisting and tortional movements of snow skiing while providing apparatus which is readily portable, simple to use and requires no special boots or other equipment for use.

SUMMARY OF THE INVENTION

The present invention relates to apparatus for the exercise of muscles used in skiing which may be used in a relatively limited space and may be used without special boots or other auxiliary equipment. A pair of raised platforms is rotatively supported over a base. The platforms are biased together to provide resistive force to pivoting movement. The platforms may additionally be supported by mechanisms which effectuate rocking action in series with the pivoting mechanisms. Anchor means are provided for placement of ski pole tips.

One objective of the invention is to provide apparatus to strengthen foot, ankle, knee and leg muscles involved in the twisting and torsional movements of snow skiing.

Another objective is to provide apparatus to simulate ski manuevers such as slalom turns, stem-christies, stem-turns and parallel runs.

Another objective is to provide a ski exercise apparatus which can be used by any skier regardless of size or age, without the necessity of special boots or other equipment, and without any need for adjustments or calibrations.

Another objective is to provide apparatus which simulates the "edging" movements of snow skiing.

Another objective is to provide ski exercise apparatus which is portable, compact and inexpensive to produce.

These objectives and others will be apparent from the ensuing description.

DETAILED DESCRIPTION OF THE INVENTION

Figure 1:
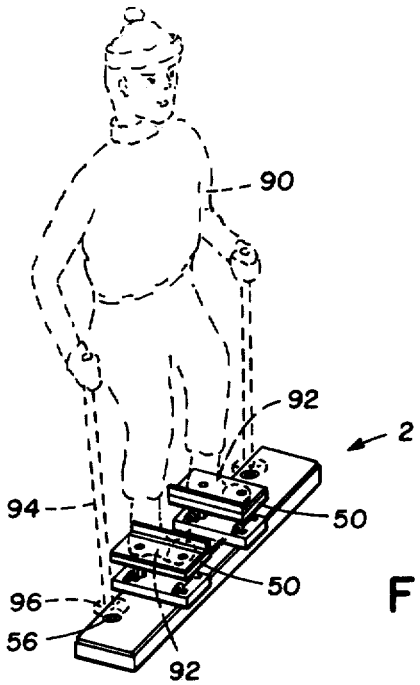
FIG. 1 is a perspective of the invention in a working application.

FIG. 1 shows invention 2 in use by user 90. User's feet 92 are positioned atop foot platforms 50. Lower end 96 of ski pole 94 is placed in well 56.

Figure 4:
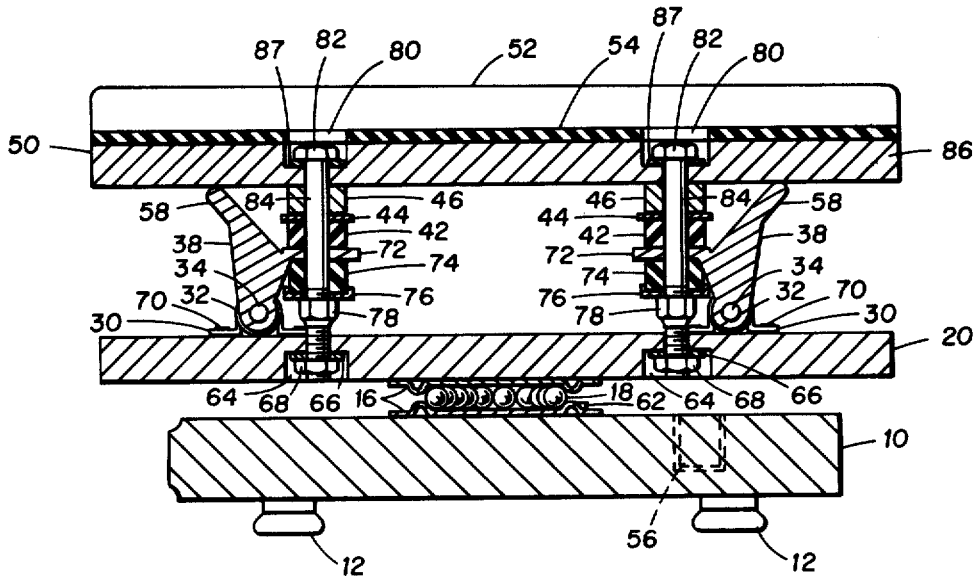
FIG. 4 is a section view along 4—4 of FIG. 3.
Figure 5:
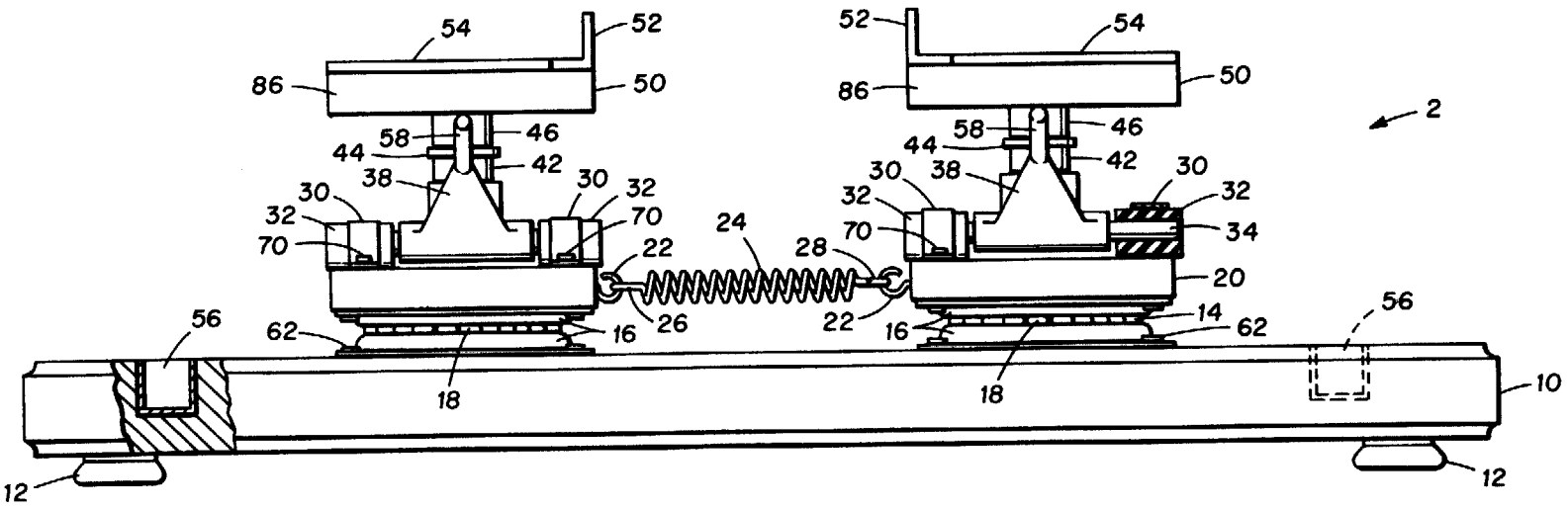
FIG. 5 is a front view of the invention, partially in section.

Referring to the drawings and in particular to FIGS. 4 and 5, the invention 2 comprises base 10, which is equipped with conveniently positioned supporting feet 12. Mounted atop base 10 are a pair of rotative bearing members 14 each comprising a pair of opposing housing members 16 and a plurality of bearing members 18. Securing opposing housing members 16 to base 10 are screws 62. First platform members 20 are mounted substantially centrally over each bearing member 14. Attached to first platform members 20 are hooks 22. Spring 24 has first end 26 and second end 28, said first end 26 being attached to hook 22 of one first platform member 20 and said second end 28 being attached to a hook 22 of the other first platform member 20. Retaining members 30 retain tubular bearings 32 to first platform members 20. Mounting screws 70 mount retaining member 30 to first platform members 20. Shaft 34 extends from opposing ends of stabilizing member 38 and into tubular bearings 32. Plate 44 separates upper flexible bushing 42 from spacer 46. Mounted above spacer 46 is foot platform 50. Vertically extending angled bar 52 is mounted to base member 86 of foot platform 50. Mat 54 is affixed to the top surface of base member 86. Wells 56 are embedded in base 10.

Referring now to FIG. 4, indentation 64 is formed in the lower surface of first platform member 20 in which is located washer 66 and nut 68. Upper extension 58 of stabilizing member 38 intercepts the underside of foot platform 50 in touching relationship. Upper flexible bushing 42 is positioned below plate 44 and above flattened extension 72 of stabilizing member 38. Lower flexible bushing 74 is positioned below flattened extension 72 of stabilizing member 38. End cap 76 is positioned adjacent lower flexible bushing 74 and is held in place by nut 78. Countersink opening 80 is formed in base member 86 of foot platform 50 within which is located washer 87 and head 82 of bolt 84. Bolt 84 extends through base member 86 of foot platform 50 and then through spacer 46, plate 44, upper flexible bushing 42, flattened extension 72 of stabilizing member 38, lower flexible bushing 74 and end cap 76. Bolt 84 further extends through nut 78 and first platform member 20 and terminates with washer 66 and nut 68, thus attaching first platform member 20 and foot platform 50 in variable cushioned relationship.

Figure 3:
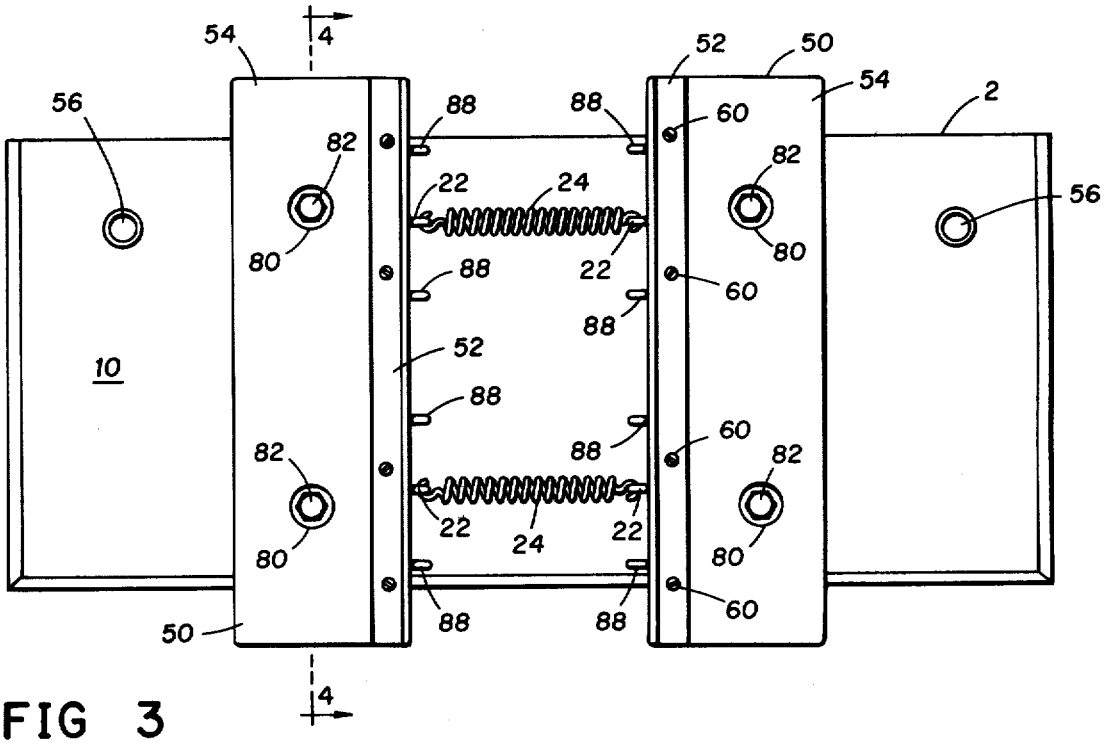
FIG. 3 is a top view of the invention.

FIG. 3 shows a view of invention 2 from above. Springs 24 interconnect hooks 22 of foot platforms 50. Alternative hooks 88 are affixed to foot platforms 50 in similar fashion to the connection of hooks 22 and are available for alternative placement of springs 24 to vary the resistance to rotational movement of foot platforms 50. Mounted by screws 60 to the upper surface of base member 86 of each foot platform 50 is vertically extending angled bar 52. Also mounted to said upper surface of base member 86 is mat 54.

Figure 2A:
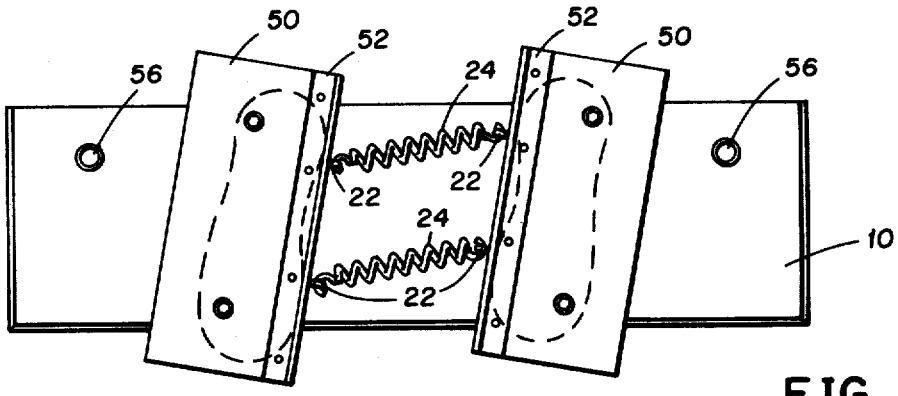
FIG. 2*a* is a top view of the invention in partial rotation.

Referring now to FIG. 2*a*, the invention is shown from above. Foot platforms 50 are rotated in parallel relationship. Springs 24 interconnect hooks 22 and are partially extended due to the rotation of foot platforms 50, said springs 24 thereby providing resistance to said rotation. Each foot platform 50 has affixed thereto an angled bar 52. Wells 56 are deployed in the base 10.

Figure 2B:
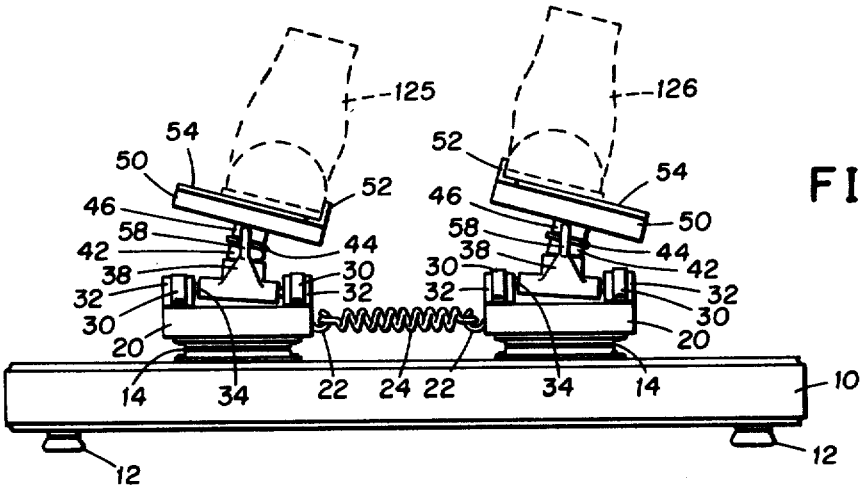
FIG. 2*b* is a front view of the invention in use with the foot platforms tilted relative to the base.

FIG. 2*b* shows the invention in use in its tilting function, from a front view. The placement of a user's shoes 125 and 126 is shown atop foot platforms 50, resting on mat 54 and adjacent vertically extending angled bar 52 of each foot platform 50. Platform members 20 are shown in their quiescent position without rotative deflection. Springs 24 fastened between hooks 22 interconnect platform members 20. Spacer 46 is mounted below each foot platform 50 and above plate 44. Upper flexible bushings 42 are positioned below plates 44 and are here shown in a partially compressed state. Upper extensions 58 of stabilizing members 38 engage the lower surfaces of foot platforms 50 in touching relationship. Stabilizing members 38 are shown with shaft 34 extending therefrom into tubular bearings 32 which are retained to platform members 20 by retaining members 30. Rotative bearing members 14 support each platform member 20 over base 10 which is equipped with feet 12.

Figure 6:
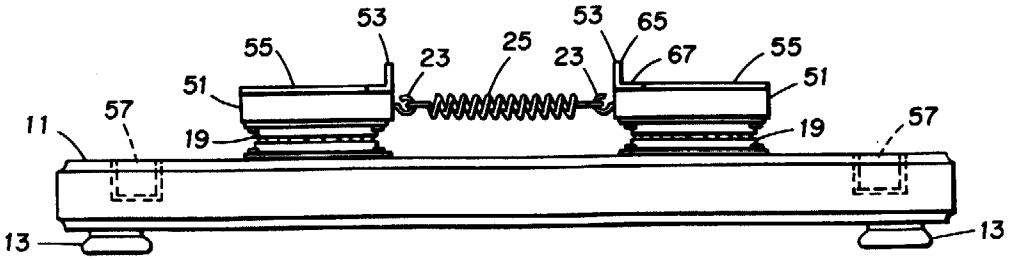
FIG. 6 is a front view of an alternative embodiment of the invention.

FIG. 6 discloses an alternative embodiment of the invention. Base 11 is equipped with feet 13 and has depressions 57 imbedded therein. A pair of platforms 51 is interconnected by a plurality of springs 25 which are detachably connected to foot platforms 51 by hooks 23. Mounted on the top surface of each foot platform 51 is friction-creating mat 55 and angled bar 53, comprising edge plate 65 and base plate 67. Rotative bearing assemblies 19 support each foot platform above base 11.

Having thus described my invention, I claim:

1. Apparatus for exercise of muscles used in skiing comprising a base, a pair of rotational bearing members fixed to said base, a pair of platform members each positioned substantially centrally over each of said bearing members, a plurality of coil springs each with a first end and a second end, the first end of each of said coil springs being attached to one of the platform members and the second end of each of said coil springs being attached to the other of the platform members, a pair of rocker assemblies is mounted upon each of said platform members, a foot platform is mounted centrally over each of said pairs of rocker assemblies, each of said rocker assemblies comprises an upper and a lower flexible bushing, a formed member, a pair of tubular bushings, and a pair of retaining members, said formed member has a horizontally extending flattened portion, a vertical extension and a body, said body of said formed member has extending from the opposite sides thereof a shaft, said shaft passes through said tubular bushings, said tubular bushings are fixed to said platform members by said retaining members, said flattened portion is positioned between said upper and said lower flexible bushings, said vertical extensions engage the lower surfaces of said foot platforms in touching relationship thereto, said upper flexible bushings are fixed to the lower surfaces of said foot platforms, said lower flexible bushings are fixed to the upper surfaces of said platform members.

2. Exercise apparatus comprising a base, a first rotatable platform member attached to said base, a second rotatable platform member attached to said base and spaced from said first rotatable platform member, a plurality of tensioning members affixed to and interconnecting the opposing edges of each of said platform members, each of said tensioning members being positioned substantially parallel to the other tensioning members, said tensioning members resisting rotational movement of said platform members.

3. The invention of claim 2 wherein said tensioning members comprise strips of elastic material.

4. The invention of claim 2 wherein said tensioning members comprise coil springs.

5. The invention of claim 2 wherein said platform members are mounted to said base by a pair of rotational bearing members, said bearing members are mounted substantially centrally along said platform members, said tensioning members are detachably fastened to the adjacent edges of said platform members, said platform members each have a plurality of fasteners along the opposing edges thereof for variable attachment of said tension members thereto.

6. The invention of claim 2 wherein said platform members each have a vertically extending plate along the length of the opposing sides thereof.

7. The invention of claim 2 wherein each of said platform members is tiltable throughout a limited range independent of the other platform member.

8. The invention of claim 2 wherein each of said platform members has a first end and a second end, said tensioning members exerting substantially equal forces upon said first ends of said platform members and on said second ends of said platform members.

* * * * *